US009080549B2

(12) United States Patent
Bergmann et al.

(10) Patent No.: US 9,080,549 B2
(45) Date of Patent: Jul. 14, 2015

(54) HYDROSTATIC AXIAL PISTON MACHINE

(75) Inventors: Martin Bergmann, Schaafheim (DE); Robert Schlosser, Waldaschaff (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 986 days.

(21) Appl. No.: 13/161,951

(22) Filed: Jun. 16, 2011

(65) Prior Publication Data

US 2012/0000354 A1 Jan. 5, 2012

(30) Foreign Application Priority Data

Jul. 2, 2010 (DE) ..... 10 2010 025 910

(51) Int. Cl.
*F04B 1/20* (2006.01)
*F03C 1/32* (2006.01)

(52) U.S. Cl.
CPC ..... *F03C 1/0652* (2013.01); *F04B 1/2035* (2013.01)

(58) Field of Classification Search
CPC ..... F03C 1/0652; F03C 1/0636; F03C 1/06; F04B 1/12; F04B 1/20; F04B 1/128
USPC ..... 92/12.2, 57, 71; 91/499; 417/269
See application file for complete search history.

(56) References Cited

U.S. PATENT DOCUMENTS 6,119,580 A * 9/2000 Sato et al. ..... 92/12.2
2005/0196289 A1* 9/2005 Fiebing et al. ..... 417/222.1

FOREIGN PATENT DOCUMENTS

| | | | |
|---|---|---|---|
| JP | 7167044 | A | 7/1995 |
| JP | 7180653 | A | 7/1995 |
| JP | 968155 | A | 3/1997 |
| JP | 11241674 | A | 9/1999 |
| JP | 2000120529 | A | 4/2000 |

* cited by examiner

*Primary Examiner* — Nathaniel Wiehe
*Assistant Examiner* — Abiy Teka
(74) *Attorney, Agent, or Firm* — The Webb Law Firm

(57) ABSTRACT

A hydrostatic axial piston machine (1), in particular an axial piston motor, has a rotating cylinder block (3) with a cylinder block body (3*a*) and a cylinder block neck (3*b*), and a drive shaft (14). Located in the cylinder block body (3*a*) are a plurality of piston bores (4) with pistons (5) that can move longitudinally and which are supported on a swashplate (7). Between the cylinder block neck (3*b*) which projects from the cylinder block body (3*a*) and extends in the direction of the swashplate (7) and the drive shaft (14) there is a synchronization gearing (20) and a braking device (25) that acts on the cylinder block (3). In the vicinity of the cylinder block neck (3*b*) within the axial dimension of the cylinder block body (3*a*), there is an additional synchronization gearing (21). The additional synchronization gearing (21) has a larger gear tooth clearance ($S_F$) in the vicinity of the cylinder block body (3*a*) than the synchronization gearing (21) in the vicinity of the cylinder block neck (3*b*).

16 Claims, 4 Drawing Sheets

HYDROSTATIC AXIAL PISTON MACHINE

CROSS REFERENCE TO RELATED APPLICATIONS

This application claims priority to German Application DE 102010025910.1, filed Jul. 2, 2010, which is herein incorporated by reference in its entirety.

BACKGROUND OF THE INVENTION

1. Field of the Invention

This invention relates to a hydrostatic axial piston machine, in particular, to an axial piston motor with a rotating cylinder block which comprises a cylinder block body and a cylinder block neck, and a drive shaft. A plurality of piston bores are located in the cylinder block body. Longitudinally moveable pistons are located in the piston bores and are supported on a swashplate. A synchronization gearing is located between the cylinder block neck (which projects from the cylinder block body and extends in the direction of the swashplate) and the drive shaft. A braking device acts on the cylinder block.

2. Description of Related Art

In axial piston machines of the general type that employ a swashplate construction, the pistons, which can move longitudinally in the piston bores of the cylinder block, are supported on a swashplate. As a rule, the pistons are supported on the swashplate by a sliding shoe connected with the corresponding piston by a sliding shoe joint, such as a ball-and-socket joint. Torque is transmitted between the cylinder block and the drive shaft by a synchronization gearing, which makes possible both an axial mobility of the cylinder block and a limited angular adjustment capability of the cylinder block. As a result, the position of the cylinder block on a control plate can be adjusted. The cylinder block is supported on the drive shaft at the intersection between the plane of the midpoints of the sliding shoe joints and the axis of rotation of the drive shaft. In axial piston machines of the known art, this intersection lies axially outside the cylinder block, i.e., axially between the cylinder block and the swashplate. For this reason, on axial piston machines of the known art, the cylinder block body is elongated toward the swashplate by a projecting cylinder block neck. The synchronization gearing is located on or in the vicinity of the cylinder block neck. As a result, the transverse force that is generated by the resolution of forces on the sliding shoe joints can be transmitted and supported without causing undesirable tipping forces on the cylinder block. If, when viewed in the axial direction, the center of the overlap area between the synchronization gearing on the cylinder block neck essentially coincides with the intersection of the plane that is formed by the sliding shoe midpoints and the axis of rotation of the drive shaft or of the cylinder block, an undesirable tipping moment on the cylinder block that would lead to a tipping of the cylinder block away from the control surface can be prevented by the transverse forces that occur.

The design of an axial piston machine of the known art requires a low wall thickness of the cylinder block neck, which is drawn out from the cylinder block body in the axial direction and is provided with the hub profile of the synchronization gearing. As a result of the simultaneous transmission of the torque and the transverse force, high loads are exerted on the cylinder block neck and on the transition between the cylinder block neck and the cylinder block body, as a result of which a material with appropriately high strength must be used.

If a generic axial piston machine also has a braking device which acts on the cylinder block, preferably on the cylinder block body, when the braking device is actuated into the braking position, the braking torque is also applied to the synchronization gearing in the vicinity of the cylinder block neck. Additional loading and stressing of the synchronization gearing are caused by the braking torque, especially if hydrostatic forces and torques are transmitted simultaneously and the braking device is used as an operating brake to decelerate the rotating drive shaft.

The high stresses on the cylinder block neck are accompanied by the risk that the cylinder block neck may break away from the cylinder block body and become detached from the cylinder block body. The synchronization gearing between the cylinder block neck and the drive shaft can also fail. In the event of such failures that involve a failure of the synchronization gearing, the braking torque of the braking device can no longer be transmitted to the drive shaft on account of the lack of synchronization gearing between the drive shaft and the cylinder block neck, which results in a loss of the braking action.

Therefore, it is an object of the invention to provide an axial piston machine of the general type described above but in which the full functional capability of the braking device is preserved in the event of a failure of the synchronization gearing.

SUMMARY OF THE INVENTION

The invention teaches that, in addition to the first synchronization gearing (first driving gearing) on or in the vicinity of the cylinder block neck within the axial dimension of the cylinder block body, there is a second or additional synchronization gearing (second driving gearing). The additional synchronization gearing in the vicinity of the cylinder block body has a larger gear tooth clearance than the synchronization gearing in the vicinity of the cylinder block neck. A teaching of the invention is therefore, that in addition to the synchronization gearing in the vicinity of the cylinder block neck, there is an additional, redundant synchronization gearing within the axial length of the cylinder block body, which engages in the event of a failure of the synchronization gearing, for example, as a result of a failure of the synchronization gearing or a rupture of the cylinder block neck, and makes it possible for the braking torque of the braking device to be transmitted from the cylinder block body to the drive shaft. The invention teaches that the additional synchronization gearing has a larger lateral gear tooth clearance than the first synchronization gearing. As a result, the additional synchronization gearing is not engaged during regular operation of the axial piston machine with a fully functioning primary synchronization gearing. Consequently, in normal operation in the absence of failures or malfunctions, the transverse force can be transmitted to the cylinder block and supported via the engaged synchronization gearing in the vicinity of the cylinder block neck without the occurrence of a tipping moment, so that, on account of the presence of the additional synchronization gearing, no undesirable effects occur during regular and normal operation of the axial piston machine. The larger gear tooth clearance in the vicinity of the additional synchronization gearing has the particular advantage that the additional synchronization gearing is not exposed to any loads during normal operation of the axial piston machine because the torques and forces are transmitted and supported by the synchronization gearing in the vicinity of the cylinder block neck. In the event of damage to the equipment or a malfunctioning of the synchronization gearing, such as a failure of the synchronization gearing or a rupture of the cylinder block neck, for example, a braking moment can therefore be securely transmitted by the braking device from the cylinder block body to the driveshaft by means of the previously unused additional synchronization gearing in the vicinity of the axial dimension of the cylinder block body. Because the hub on the cylinder block side also has a greater wall thickness in the vicinity of the cylinder block body than the cylinder block neck, the reliability and safety of operation in the event of a failure or malfunction are further increased, so that the braking torque of the braking device can be transmitted safely and reliably.

In one advantageous embodiment of the invention, the additional synchronization gearing in the vicinity of the cylinder block body is located at some distance in the axial direction from the synchronization gearing in the vicinity of the cylinder block neck. The additional synchronization gearing can be located in an additional gearing area within the axial extension of the cylinder block body and at some distance in the axial direction from the gearing area on the cylinder block neck.

To minimize the cost and effort of construction, and to achieve low manufacturing costs, it is particularly advantageous if, as in one preferred embodiment of the invention, the additional synchronization gearing in the vicinity of the cylinder block body is located in the axial direction adjacent to the synchronization gearing on or in the vicinity of the cylinder block neck. The additional synchronization gearing can be easily created by an axial elongation of the existing synchronization gearing on the cylinder block neck in the area of the extension of the cylinder block body, whereby all that is necessary in the vicinity of the cylinder block body is the greater gear tooth clearance of the additional synchronization gearing.

The synchronization gearing in the vicinity of the cylinder block neck and the additional synchronization gearing in the vicinity of the cylinder block body can be formed by different gearing profiles. In one preferred embodiment of the invention, the cost and effort of design and manufacture for the additional synchronization gearing can be kept low if the synchronization gearing and the additional synchronization gearing are formed by a common gear toothing of the driveshaft and a common hub profile of the cylinder block. The additional synchronization gearing can therefore be manufactured by an easily manufactured axial elongation of the gearing on the gear shaft and of the hub profile on the cylinder block and, thus, an elongation of the synchronization gearing on the cylinder block neck.

The greater tooth clearance of the additional synchronization gearing can be achieved by a corresponding widening of the recesses of the hub profile in the cylinder block side hub. With the objective of reducing the manufacturing costs, it is further advantageous if, as in one preferred embodiment of the invention, gearing is provided on the driveshaft in the vicinity of the additional synchronization gearing with a tooth thickness that is less than the thickness of the gearing in the vicinity of the synchronization gearing. As a result of the location of the common toothing on the driveshaft with a decreasing tooth thickness which is variable in the axial direction, the increased tooth clearance in the vicinity of the additional synchronization gearing can be achieved by a simple external machining of the driveshaft. The axial recesses of the hub profile in the cylinder block can therefore be formed by easily manufactured standard recesses which extend from the cylinder block neck in the area of axial extension of the cylinder block body.

In one preferred configuration of the invention, the synchronization gearing and the additional synchronization gearing are in the form of spline shaft gears. Because of the variable tooth thickness of the gearing on the driveshaft in the axial direction, the synchronization gearing and the additional synchronization gearing can be easily manufactured with a common spline shaft gear. Alternatively, however, it is also possible to design the synchronization gearing and the additional synchronization gearing in the form of a suitable form-fitting shaft-hub connection, for example, in the form of a splined shaft profile.

In one preferred embodiment of the invention, the braking device is located radially between the cylinder block, in particular the cylinder block body, and a housing. With a braking device of this type, a braking torque can be easily exerted on the cylinder block body to decelerate the drive shaft. The braking device can thereby have the function of a parking brake and/or an operating brake. The braking device is preferably in the form of a multiple disc brake.

It is particularly advantageous if the axial piston machine is in the form of a traction motor of a traction drive on a mobile machine or a slewing gear motor of a slewing gear on a mobile machine. On account of the additional synchronization gearing of the invention, which is located in the area of the axial extension of the cylinder block body, the braking moment generated by the braking device that acts on the cylinder block body can be safely and reliably transmitted to the driveshaft in the event of an equipment failure or malfunction, for example, a failure of the synchronization gearing in the vicinity of the cylinder block neck or a rupture of the cylinder block neck. The drive shaft can thereby be reliably and safely decelerated or stopped by the braking device. With the additional synchronization gearing of the invention in a slewing gear drive or a traction drive, for example, the braking function can also be reliably preserved even in the event of damage to or failure of the synchronization gearing, as a result of which a high level of operational safety is guaranteed. An axial piston machine of the invention in the form of a traction motor can drive a drive axle. Alternatively, the traction motor can be in the form of a wheel drive, in which the axial piston motor is associated with a driven wheel of the mobile machine.

BRIEF DESCRIPTION OF THE DRAWINGS

Additional advantages and details of the invention are explained in greater detail below with reference to the exemplary embodiments illustrated in the accompanying schematic figures, in which.

DESCRIPTION OF THE PREFERRED EMBODIMENTS

Figure 1:
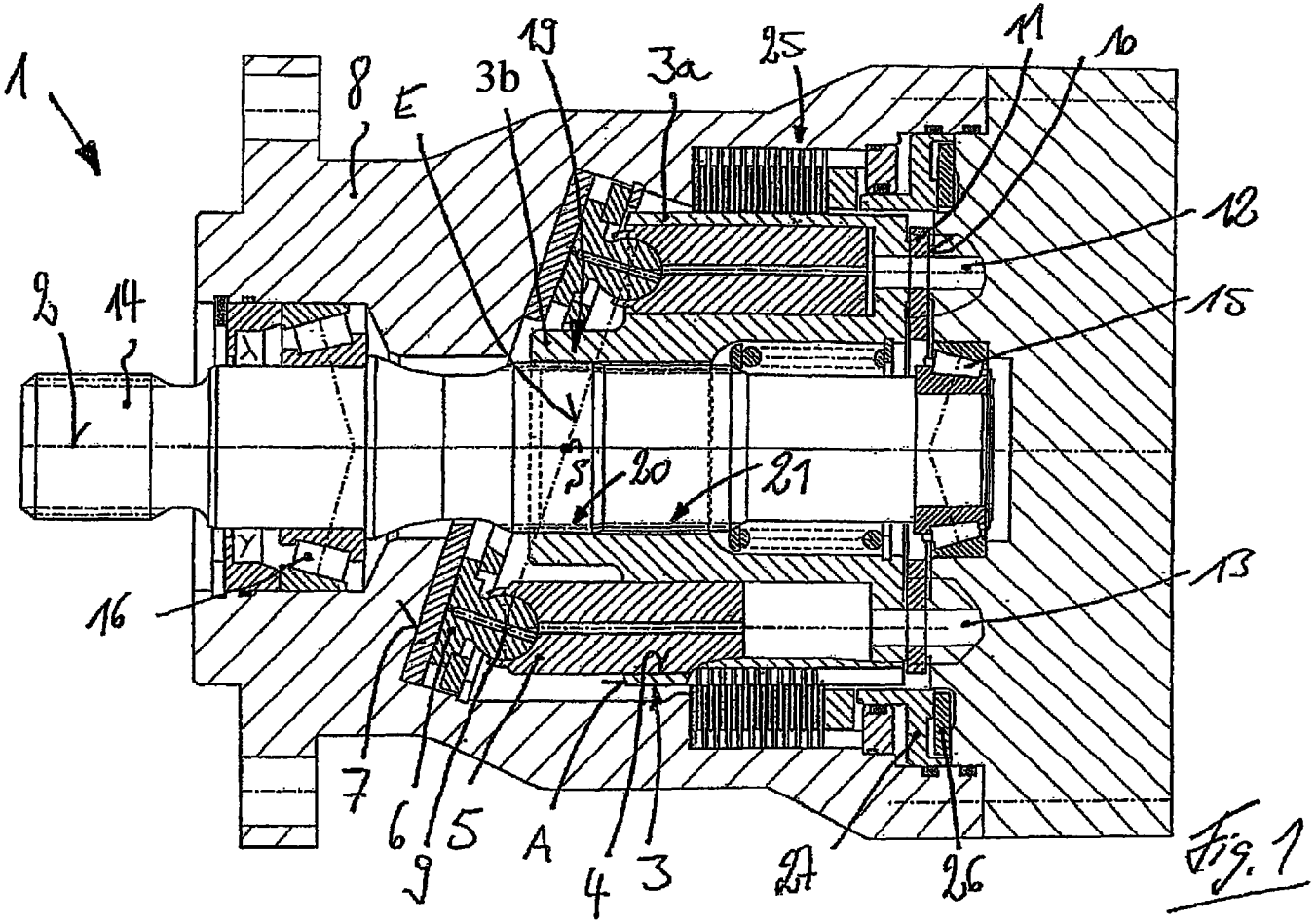
FIG. 1 illustrates a first embodiment of an axial piston machine of the invention in longitudinal section.

FIG. 1 shows a hydrostatic axial piston machine 1, for example, an axial piston motor that employs a swashplate construction. The axial piston machine 1 has a cylinder block 3 that is mounted so that it can rotate around an axis of rotation 2. The cylinder block 3 is provided with a plurality of concentric piston bores 4 arranged concentrically around the axis of rotation 2. The piston bores 4 are preferably formed by cylinder bores and in each of which a work piston 5 is mounted so that it can move longitudinally.

The work pistons 5 are each supported in the area projecting from the cylinder block 3 on a swashplate 7 by means of a sliding shoe 6. The swashplate 7 can be molded or fastened onto a housing 8, whereby the axial piston machine 1 has a fixed displacement volume. It is also possible to make the swashplate 7 adjustable, as a result of which the axial piston machine 1 has a variable displacement volume.

The cylinder block 3 is supported in the axial direction on a control surface 10, which is stationary with respect to the housing 8 and is located on a disk-shaped control plate 11, which is non-rotationally fastened to the housing 8 or a corresponding housing cover. The control plate 11 is provided with kidney-shaped control slots which form a suction connection passage 12 and a compression connection passage 13.

The work pistons 5 are connected by a sliding shoe joint 9 in the form of a ball-and-socket joint with the respective sliding shoe 6. The center points of the sliding shoe joints 9 are located in a common plane E, which is illustrated by a broken line in FIG. 1 and has an intersection S with the axis of rotation 2 of the cylinder block 3.

The intersection S is located between an end surface A of the cylinder block 3, in which the piston bores 4 emerge on the swashplate 7 side (i.e., the end surface A contains the piston outlet openings), and the swashplate 7 and is therefore outside the axial dimension of the cylinder block 3.

The cylinder block 3 is traversed by a central boring through which a driveshaft 14, which is oriented concentrically with respect to the axis of rotation 2, is guided through the cylinder block 3. The drive shaft 14 is rotationally mounted in the housing 8 by bearings 15, 16. In an area at some axial distance from the control surface 10, the cylinder block 3 is supported in the radial direction by a support bearing 19 on the drive shaft 14.

The cylinder block 3 includes of a cylinder block body 3*a*, in which the piston bores 4 of the pistons 5 are located, and a cylinder block neck 3*b*, which extends in the axial direction from the end surface A of the cylinder block body 3*a* toward the swashplate 7. The cylinder block neck 3*b* is in this case in the form of an axially projecting section on the cylinder block body 3*a*. A first or primary synchronization gearing 20 is located on or in the vicinity of the cylinder block neck 3*b*, which is preferably formed by a spline shaft gearing. The synchronization gearing 20 formed by the spline shaft gearing simultaneously forms the support bearing 19. By means of the synchronization gearing 20, the cylinder block 3 is located torque-proof and can be displaced longitudinally on the drive shaft 14.

Figure 2:
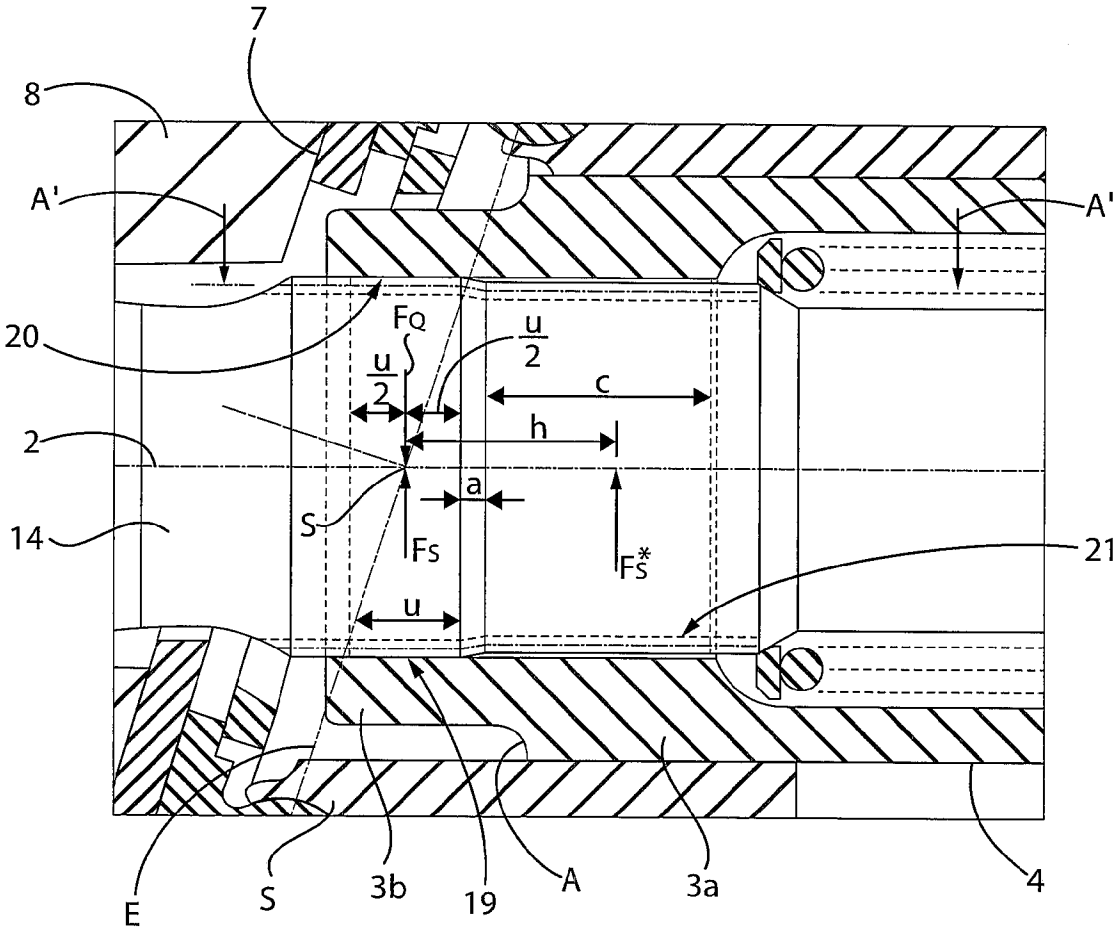
FIG. 2 is an enlarged detail of the embodiment illustrated in FIG. 1.

As illustrated in FIG. 2, the synchronization gearing 20 between the driveshaft 14 and the cylinder block 3 has an axial overlap area or engagement area "u", the center u/2 of which in the axial direction essentially coincides with the intersection S between the plane E formed by the midpoints of the sliding shoe joints 9 and the axis of rotation 2 of the cylinder block 3. Consequently, the transverse force $F_Q$ originating from the resolution of forces on the sliding shoe joints 9 can be transmitted without undesirable tipping forces to the drive shaft 14 and supported by a support force $F_S$.

As shown in FIG. 1, the axial piston machine 1 of the invention is also provided with a braking device 25 which acts on the cylinder block 3 in the vicinity of the cylinder block body 3*a*. The braking device 25 is located radially between the cylinder block body 3*a* and the housing 8 and acts on the cylinder block body 3*a*. The braking device 25 is preferably in the form of a multiple disc brake which has a plurality of outer disks which are non-rotationally connected with the housing 8 and inner disks which are non-rotationally connected with the cylinder block body 3*a*. The braking device 25 is in the form of a parking brake and/or operating brake and can be actuated by a spring device 26 into a braking position and by means of an actuator device 27 into a release position. In the exemplary illustrated embodiment, the actuator device is formed by a hydraulically actuated ring piston for the hydraulic release of the braking device 25.

The invention also teaches that, in addition to the first or primary synchronization gearing 20 that forms the support bearing 19 and is arranged in the vicinity of the cylinder block neck 3*b*, there is an additional second or secondary synchronization gearing 21 inside the axial dimension of the cylinder block body 3*a*. The additional synchronization gearing 21 has a larger lateral gear tooth clearance in the vicinity of the cylinder block body 3*a* than the synchronization gearing 20 in the vicinity of the cylinder block neck 3*b*.

Figure 3:
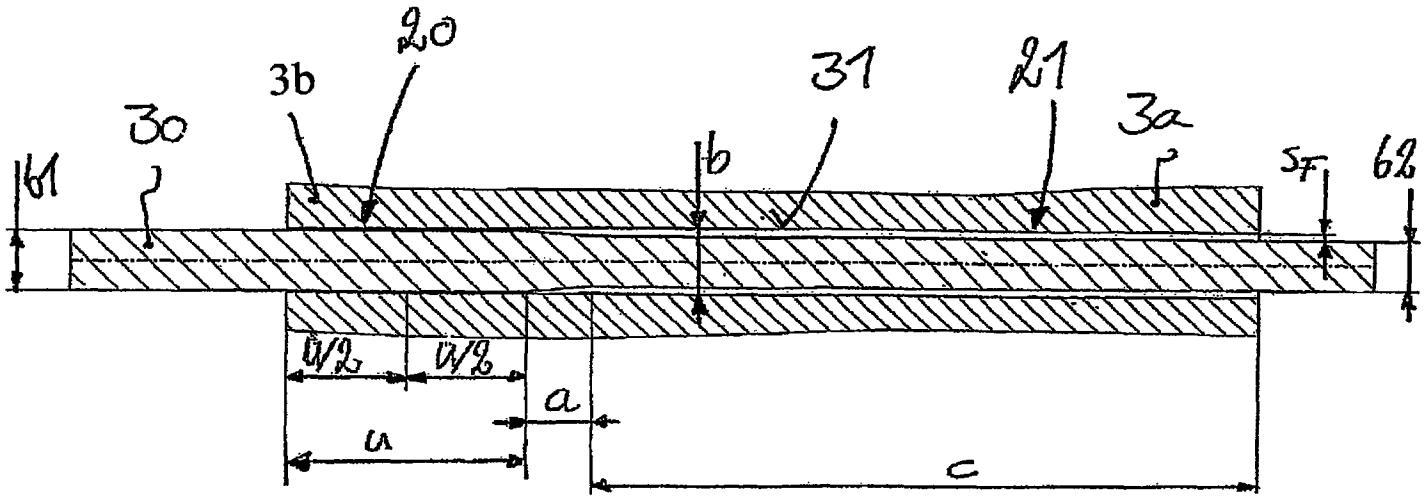
FIG. 3 is a section along the line A'-A' in FIG. 2.

FIG. 3 shows a longitudinal section along the line A'-A' of FIG. 2 through the synchronization gearing 20 and the additional synchronization gearing 21 in the form of a gearing profile.

The synchronization gearing 20, in the form of spline shaft gearing, has a spline shaft profile with corresponding spline profiles 30 in the form of axial gearing on the outside circumference of the drive shaft 14 and longitudinal grooves 31 on the inside of the hub-side cylinder block 3 that mesh with the spline profiles 30, in the form of axial recesses in the hub profile.

As illustrated in FIGS. 1 to 3, the synchronization gearing 20 is elongated in the vicinity of the cylinder block neck 3*b* in the axial direction toward the cylinder block housing 3*a*. The synchronization gearing 20 and the additional synchronization gearing 21 are, in this case, formed by a common gearing on the drive shaft 14 which is formed by corresponding spline profiles 30, and a common hub profile in the cylinder block 3 which is formed by the axial longitudinal grooves 31.

The longitudinal grooves 31 in the cylinder block 3, which extend from the cylinder block neck 3*b* into the axial dimensional area of the cylinder block body 3*a*, have an unvarying cross-section with the uniform width b. The gearing located on the drive shaft 14, which gearing is formed by the corresponding spline profiles 30, has a variable tooth thickness in the axial direction. In the vicinity of the cylinder block neck 3*b* and, thus, of the synchronization gearing 20, the spline profiles 30 have a width b1 and in the vicinity of the cylinder block body 3*a* and, thus, of the additional synchronization gearing 21 a width b2, which is smaller than the width b1. FIG. 3 also shows the overlap area or the engagement area "u" of the synchronization gearing 20 and an adjacent area "c" which corresponds to the engagement area of the additional synchronization gearing 21. The profiling of the gearing on the drive shaft 14 is further selected so that the lateral force $F_Q$ and the support force $F_S$ (see FIG. 2) are essentially applied in the center of the overlap area "u" and thus at the intersection S, to prevent undesirable tipping forces on the cylinder block 3 during the support of the lateral force $F_Q$.

In FIGS. 2 and 3, a transitional area between the synchronization gearing 20 located in the overlap area "u" and the additional synchronization gearing 21 located in the area "c' is designated "a". In the transitional area "a" between the engagement areas of the synchronization gearings 20, 21, the width "b" of the spline profile 30 is reduced and thus the tooth thickness of the gearing on the drive shaft 14 is reduced, and there is also a reduction of the outside diameter of the drive shaft 14. Consequently, in the area "c" and, thus, in the area of engagement of the additional synchronization gearing 21, there is a lateral gear tooth clearance $S_F$ which is larger than that of the synchronization gearing 20.

In the exemplary embodiment illustrated in FIGS. 1 and 3, the additional synchronization gearing 21 is located immediately adjacent to the synchronization gearing 20.

Figure 4:
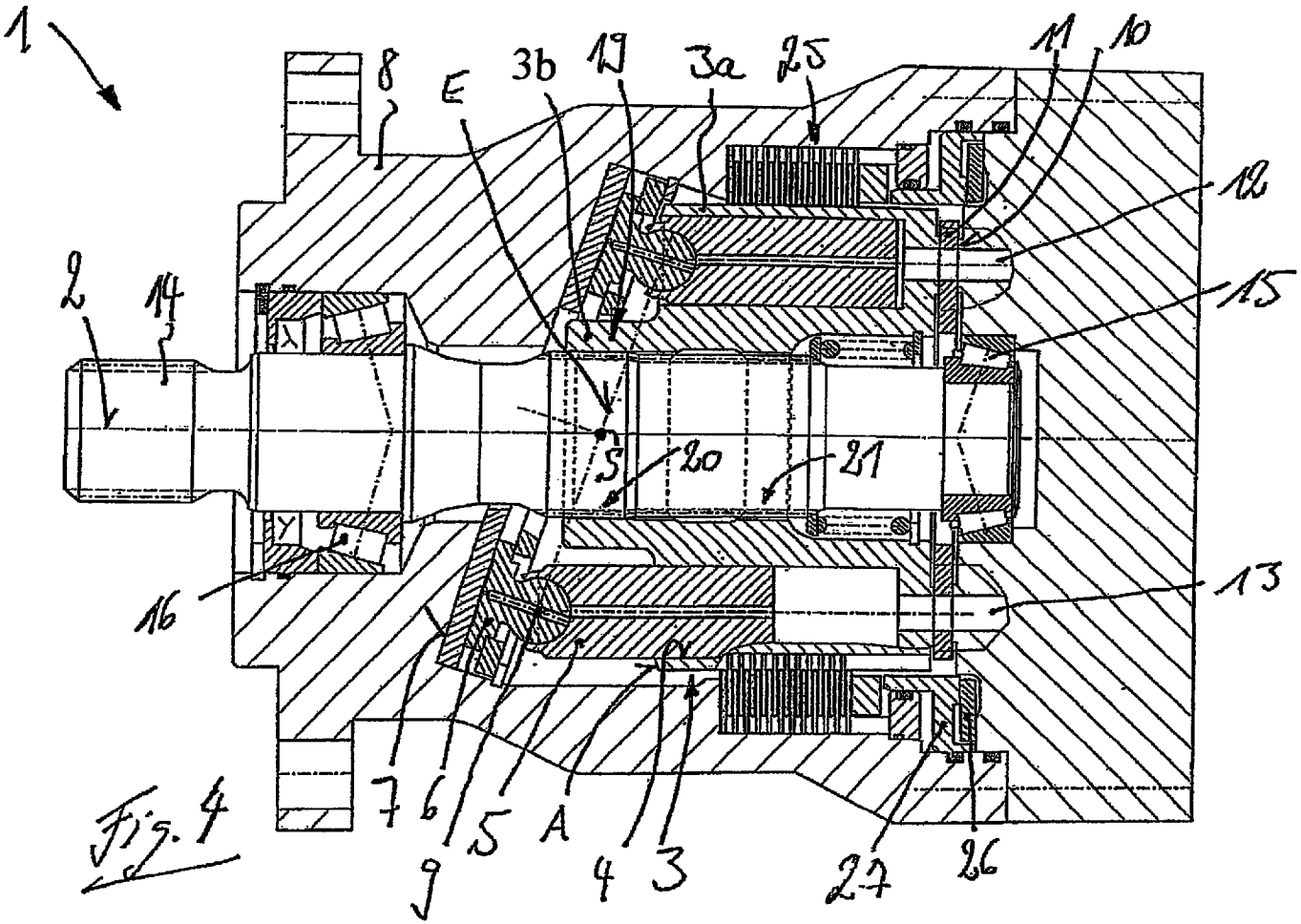
FIG. 4 illustrates a second embodiment of an axial piston machine of the invention in longitudinal section.

As shown in FIG. 4, the additional synchronization gearing 21 within the axial dimension of the cylinder block body 3*a* can be at some distance in the axial direction from the synchronization gearing 20 in the area of the cylinder block neck 3*b* and can be located in an area of the cylinder block body 3*a* closer to the control surface 10. With regard to the design and realization of the synchronization gearing 20 and of the additional synchronization gearing 21, FIG. 4 can be identical to FIGS. 1 and 3.

During normal, regular operation of the axial piston machine 1, the torque is transmitted to and the transverse force $F_Q$ is supported on the synchronization gearing 20. During such normal operation, the gearing (spline profiles 30), in the vicinity of the additional synchronization gearing 21, is not engaged with the hub profile (grooves 31) in the cylinder block body 3*a* on account of the larger gear tooth clearance $S_F$.

A failure of the synchronization gearing 20 can be caused by damage to the hub of the cylinder block 3 or the drive shaft 14 in the vicinity of the cylinder block neck 3*b*. For example, the gearing on the drive shaft 14 or on the cylinder block neck 3*b* can fracture as a result of the effects of a permanent load. In addition, a failure of the synchronization gearing 20 can be caused by an overload or a shearing of the cylinder block neck 3*b* away from the cylinder block body 3*a*.

If damage of this type does occur with a failure of the synchronization gearing 20, the additional synchronization gearing 21 is engaged, so that the forces and torque are transmitted in the axial area "c" and, thus, in the area of engagement of the additional synchronization gearing 21 inside the axial dimension of the cylinder block body 3*a* and no longer, as before, in the overlap area "u" of the synchronization gearing 20 on the cylinder block neck 3*b*. The additional synchronization gearing 21 located in the area "c" thereby has better strength characteristics. On one hand, the wall thickness in the area of the cylinder block body 3 is greater than the wall thickness of the cylinder block neck 3*b*, and on the other hand, the additional synchronization gearing 21, on account of the larger gear tooth clearance $S_F$, has not yet been in engagement during normal operation of the axial piston machine 1 and, thus, has not been exposed to any permanent loads. In the event of a failure of the synchronization gearing 20, as a result of the engagement of the additional synchronization gearing 21, the braking torque exerted by the braking device 25 on the cylinder block body 3*a* can be safely and reliably transmitted to the drive shaft 14. In particular on a slewing gear drive or in a traction drive, in the event of a failure of the synchronization gearing 20, the additional synchronization gearing 21 of the invention makes it possible to safely and reliably brake the drive shaft 14 and hold it in a stationary position.

In the event of a failure of the synchronization gearing 20, the supporting force $F_S$* is applied in the central segment of the area "c" of the additional synchronization gearing 21. Consequently, a lever arm "h" (see FIG. 2) is formed between the hydrostatic transverse force $F_Q$ exerted, which equals the sum of the piston transverse forces, and the support force $F_S$*. With this lever arm "h", a hydrostatic disturbance torque and tipping moment is formed, which results in a tipping of the cylinder block 3 away from the control surface 10. As a result of the tipping of the cylinder block 3 away from the control surface 10, in the event of a failure of the synchronization gearing 20, an increased leakage flow occurs at the control surface 10 which undesirably and significantly interferes with the function of the axial piston machine 1 and no longer guarantees the correct operation of the axial piston machine 1. This effect has been deliberately selected in the invention to make a failure of the synchronization gearing 20 noticeable from the outside and to indicate such a failure. A breaking or stopping of the drive shaft 14 in a stationary position can therefore be accomplished safely and reliably in the event of a malfunction or damage.

The additional synchronization gearing 21 can be easily created by the common spline shaft gearing because only the gearing in the form of the spline profiles 30 on the driveshaft 14 and the hub profile in the form of the longitudinal grooves 31 must be extended from the cylinder block neck 3*b* within the axial dimension of the cylinder block body 3*a*, whereby the greater gear tooth clearance $S_F$ of the additional synchronization gearing 21 can be created by an appropriate profiling of the drive shaft 14 and corresponding reduction of the tooth thickness of the tooth profiles formed by the spline profiles 30. The additional synchronization gearing 21 can, therefore, be manufactured easily and economically without a requirement for additional components.

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A hydrostatic axial piston machine, comprising:

a rotational cylinder block comprising a cylinder block body and a cylinder block neck, wherein the cylinder block body includes a plurality of piston bores with pistons that are moveable longitudinally in the bores and are supported on a swashplate;

a driveshaft, a first synchronization gearing located between the cylinder block neck and the driveshaft, wherein the cylinder block neck projects from the cylinder block body and extends toward the swashplate; and a braking device that acts on the cylinder block, wherein in addition to the first synchronization gearing there is a second synchronization gearing inside an axial dimension of the cylinder block body between the cylinder block body and the driveshaft, wherein the second synchronization gearing has a larger lateral gear tooth clearance between the cylinder block body and the driveshaft than a lateral gear tooth clearance of the first synchronization gearing between the cylinder block neck and the driveshaft.

2. The hydrostatic axial piston machine of claim 1, wherein the second synchronization gearing is separated in the axial direction from the first synchronization gearing.

3. The hydrostatic axial piston machine of claim 2, wherein the first synchronization gearing and the second synchronization gearing are formed by a common gearing of the driveshaft and a common hub profile of the cylinder block.

4. The hydrostatic axial piston machine of claim 2, wherein a gearing on the driveshaft in the second synchronization gearing is provided with a tooth thickness that is less than a tooth thickness of the first synchronization gearing.

5. The hydrostatic axial piston machine of claim 1, wherein the second synchronization gearing is located adjacent in the axial direction to the first synchronization gearing.

6. The hydrostatic axial piston machine of claim 5, wherein the first synchronization gearing and the second synchronization gearing are formed by a common gearing of the driveshaft and a common hub profile of the cylinder block.

7. The hydrostatic axial piston machine of claim 5, wherein a gearing on the driveshaft in the second synchronization gearing is provided with a tooth thickness that is less than a tooth thickness of the first synchronization gearing.

8. The hydrostatic axial piston machine of claim 1, wherein the first synchronization gearing and the second synchronization gearing are formed by a common gearing of the drive shaft and a common hub profile of the cylinder block.

9. The hydrostatic axial piston machine of claim 8, wherein a gearing on the driveshaft in the second synchronization gearing is provided with a tooth thickness that is less than a tooth thickness in the vicinity of the first synchronization gearing.

10. The hydrostatic axial piston machine of claim 8, wherein the first synchronization gearing and the second synchronization gearing are in the form of spline shaft gearing.

11. The hydrostatic axial piston machine of claim 1, wherein a gearing on the driveshaft in the second synchronization gearing is provided with a tooth thickness that is less than a tooth thickness of the first synchronization gearing.

12. The hydrostatic axial piston machine of claim 11, wherein the first synchronization gearing and the second synchronization gearing are in the form of spline shaft gearing.

13. The hydrostatic axial piston machine of the claim 1, wherein the first synchronization gearing and the second synchronization gearing are in the form of spline shaft gearing.

14. The hydrostatic axial piston machine of claim 1, wherein the braking device is located radially between the cylinder block body and a housing.

15. A hydrostatic axial piston machine, comprising:

a rotational cylinder block comprising a cylinder block body and a cylinder block neck, wherein the cylinder block body includes a plurality of piston bores with pistons that are moveable longitudinally in the bores and are supported on a swashplate, and wherein the cylinder block neck projects axially from the cylinder block body toward the swashplate;

a driveshaft;

a braking device that acts on the cylinder block;

a first synchronization gearing between the cylinder block neck and the driveshaft, wherein the first synchronization gearing has a first lateral gear tooth clearance between the cylinder block neck and the driveshaft; and a second synchronization gearing between the cylinder block body and the driveshaft, wherein the second synchronization gearing has a second lateral gear tooth clearance between the cylinder block body and the driveshaft, wherein the second lateral gear tooth clearance is larger than the first lateral gear tooth clearance.

16. A hydrostatic axial piston machine, comprising:

a rotational cylinder block comprising a cylinder block body and a cylinder block neck projecting axially from the cylinder block body;

a driveshaft;

a first synchronization gearing between the cylinder block neck and the driveshaft, wherein the first synchronization gearing has a first lateral gear tooth clearance between the cylinder block neck and the driveshaft; and a second synchronization gearing between the cylinder block body and the driveshaft, wherein the second synchronization gearing has a second lateral gear tooth clearance between the cylinder block body and the driveshaft, wherein the second lateral gear tooth clearance is larger than the first lateral gear tooth clearance.

* * * * *